US007436122B1

(12) United States Patent
Beal et al.

(10) Patent No.: US 7,436,122 B1
(45) Date of Patent: Oct. 14, 2008

(54) HELICON HALL THRUSTER

(75) Inventors: Brian E. Beal, Lancaster, CA (US); Roger M. Myers, Woodinville, WA (US); Kristi H. de Grys, Bothell, WA (US); Alfred C. Wilson, Sammamish, WA (US)

(73) Assignee: Aerojet-General Corporation, Redmond, WA (US)

( * ) Notice: Subject to any disclaimer, the term of this patent is extended or adjusted under 35 U.S.C. 154(b) by 121 days.

(21) Appl. No.: 11/437,279

(22) Filed: May 18, 2006

Related U.S. Application Data

(60) Provisional application No. 60/682,795, filed on May 18, 2005.

(51) Int. Cl.
*H01J 7/24* (2006.01)

(52) U.S. Cl. ..... 315/111.21; 315/111.61; 315/111.81

(58) Field of Classification Search ..... 60/202; 313/362.1; 315/111.21, 111.61, 111.81
See application file for complete search history.

(56) References Cited

U.S. PATENT DOCUMENTS 5,859,428 A 1/1999 Fruchtman
6,640,535 B2 11/2003 Gallimore
6,982,520 B1 1/2006 de Grys
2002/0008455 A1 1/2002 Fisch
2003/0111963 A1* 6/2003 Tolmachev et al. ..... 315/111.51
2006/0168936 A1* 8/2006 Rooney ..... 60/202

OTHER PUBLICATIONS

Chen, F.F., "Experiments on Helicon Plasma Sources," Journal of Vacuum Science Technology A 10(4):1389-1401, 1992.
Chen, F.F., "Plasma Ionization by Helicon Waves,38 Plasma Physics and Controlled Fusion 33(4):339-394, 1991.
Chen, F.F., "The Low-Field Density Peak in Helicon Discharges," Physics of Plasmas 10(6):2586-2592, 2003.
Cluggish, B.P., et al., "Density Profile Control in a Large Diameter, Helicon Plasma," Physics of Plasmas 12(5):057101-1—7, 2005.
Lieberman. M.A., and A.J. Lichtenberg, Principles of Plasma Discharges and Materials Processing, 2d ed., John Wiley & Sons, Inc., Hoboken, N.J., 2005, pp. 513-527.
Yun, S., et al., "Density Enhancement Near Lower Hybrid Resonance Layer in m=0 Helicon Wave Plasmas," Physics of Plasmas 8(1):358-363, 2001.

* cited by examiner

*Primary Examiner*—David H Vu
(74) *Attorney, Agent, or Firm*—Christensen O'Connor Johnson Kindness PLLC

(57) ABSTRACT

Atoms of a propellant gas are ionized in a helicon plasma source, preferably in an annular area between inner and outer cylinders. The annular ionization area is aligned with an annular acceleration stage similar to the electrical-magnetic acceleration stage of a Hall effect thruster.

4 Claims, 11 Drawing Sheets

HELICON HALL THRUSTER

CROSS-REFERENCE TO RELATED APPLICATION

This application claims the benefit of U.S. Provisional Application No. 60/682,795, filed May 18, 2005.

BACKGROUND

Ion accelerators with closed electron drift, also known as "Half effect thrusters" (HETs), have been used for spacecraft propulsion. Representative applications are: (1) orbit changes of spacecraft from one altitude or inclination to another; (2) atmospheric drag compensation; and (3) "stationkeeping" where propulsion is used to counteract the natural drift of orbital position due to the effects such as solar wind and the passage of the moon. HETs generate thrust by supplying a propellant gas to an annular gas discharge channel. The discharge channel has a closed end or base which typically includes an anode, and an open end through which the gas is discharged. Free electrons are introduced into the area of the exit end from a cathode. The electrons are induced to drift circumferentially in the annular exit area by a generally radially extending magnetic field in combination with a longitudinal electric field, but electrons eventually migrate toward the anode. In the area of the exit end, a goal is to achieve collisions between the circumferentially drifting electrons and the propellant gas atoms, creating ions which are accelerated outward due to the longitudinal electric field. Reaction force is thereby generated to propel the spacecraft.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect of the present invention, a helicon ionization source is combined with the ion acceleration mechanism of a Hall effect thruster to provide a stream of high velocity ions for use as a spacecraft propulsion device. Improvements in overall efficiency may be obtained as compared to thrusters relying on electron-atom collisions for ion production. The benefits may vary, depending on thruster power and specific impulses.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
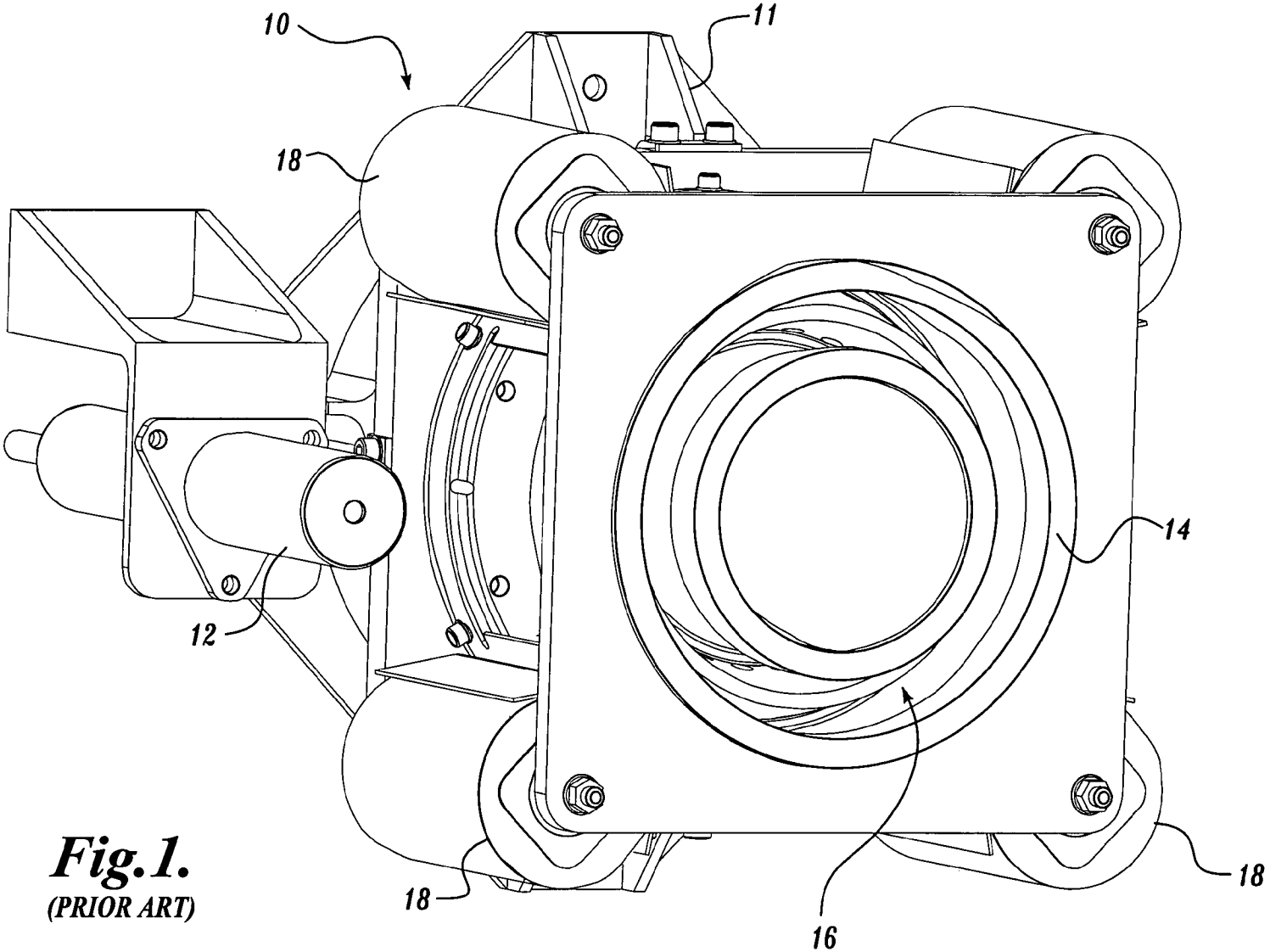
Fig. 1. (PRIOR ART)
FIG. 1 (prior art) is a diagrammatic perspective of a known Hall effect thruster (HET)

FIG. 1 illustrates a representative prior art Hall effect thruster (HET) 10, it being understood that the parts are shown diagrammatically and the dimensions exaggerated for ease of illustration and description. HET 10 is carried by a spacecraft-attached mounting bracket 11. Few details of the HET are visible from the exterior, although the electron-emitting cathode 12, exit end 14 of the annular discharge chamber or area 16, and outer electromagnets 18 are seen in this view. As described in more detail below, propulsion is achieved by ions accelerated outward, toward the viewer and to the right as viewed in FIG. 1, from the annular discharge area 16.

Figure 2:
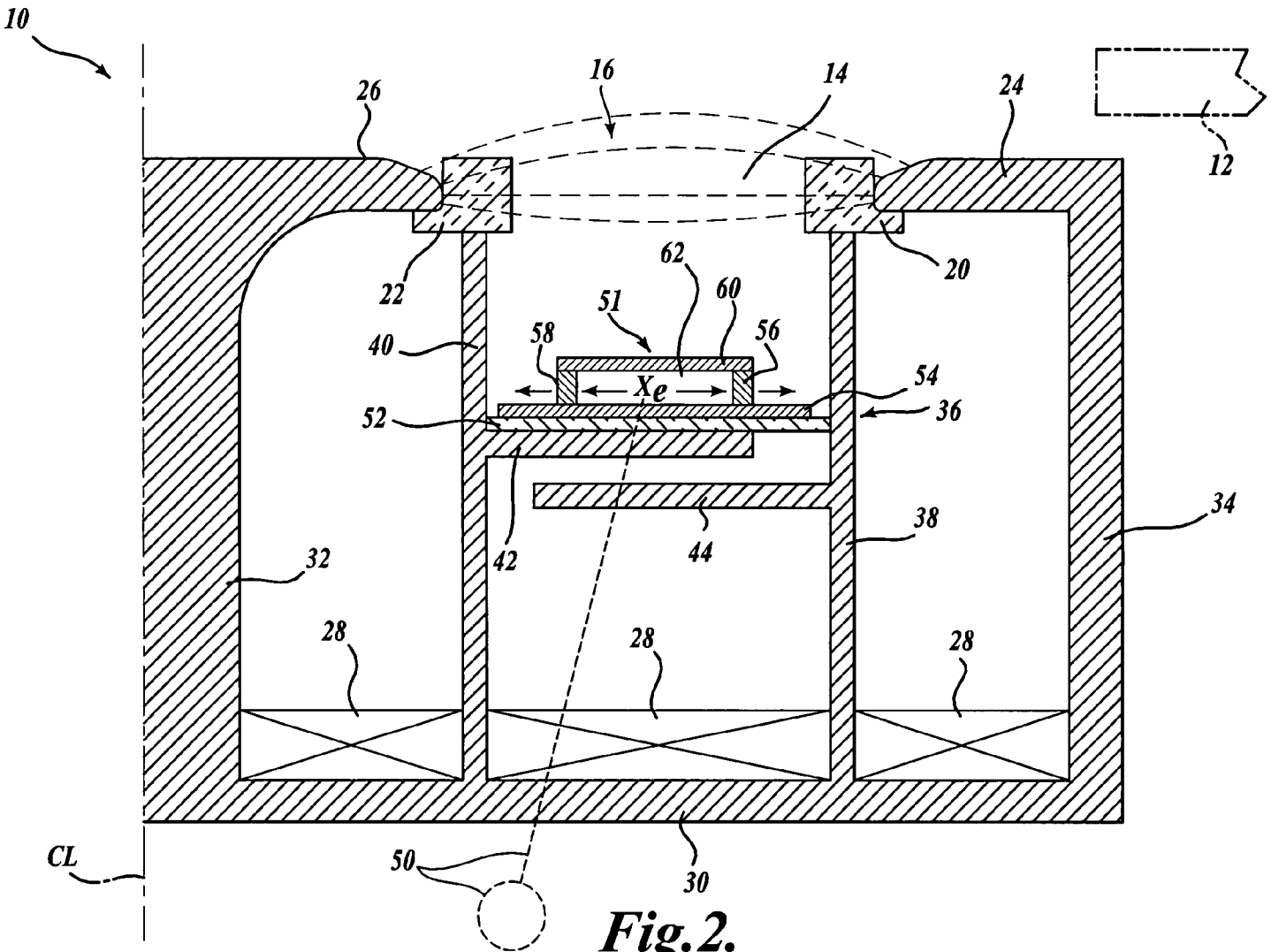
Fig.2. (PRIOR ART)
FIG. 2 (prior art) is a diagrammatic radial section of an HET of the general type shown in FIG. 1.

More detail is seen in the sectional view of FIG. 2. HET 10 has a magnetic structure which is a body of revolution about the centerline CL. The endless annular ion formation and discharge area 16 is formed between an outer ceramic ring or insulator 20 and an inner ceramic ring or insulator 22. It is desirable to create an essentially radially directed magnetic field in the exit area, between an outer ferromagnetic pole piece 24 and an inner ferromagnetic pole piece 26. In the illustrated embodiment, corresponding to commonly assigned U.S. Pat. No. 6,982,520, the radially directed magnetic field in the exit area is achieved by flux-generating coils 28, which may be variously located, but which in the embodiment shown in FIG. 2 are located adjacent to the thruster back plate 30. Back plate 30, in combination with the central core 32 and outer wall 34, form a magnetic path between the inner and outer poles 24, 26. The result of this construction is to concentrate magnetic flux in the exit end portion 14 of the discharge channel and to create a radially directed magnetic field in this area, represented by the broken lines extending between the outer and inner magnetic poles 24, 26.

In the design of FIG. 2, a magnetic shunt 36 of generally H shape is used, having an outer portion or shell 38 and an inner portion or shell 40 oriented in the axial direction. The shells define parallel magnetic segments which are magnetically coupled by the web of the "H" and the back plate 30. For example, magnetic coupling can be achieved by overlapping annular flanges 42 and 44, one (42) extending outward from the inner shell 40 and the other (44) extending inward from the outer shell 38. A source 50 of propellant gas, such as Xenon, couples to a combined gas distributor and anode 51 mounted in the base of the propellant gas discharge channel. In the design illustrated, the gas flows through porous rings 56, 58 for flow toward the exit region 14. A plate 60 closes the manifold 62 to which the propellant gas is supplied.

Cathode 12 supplies free electrons which migrate toward the annular discharge and ion creation area 14. Since the electrical field is primarily axially directed, and the magnetic field is primarily radially directed, free electrons are induced to drift circumferentially in this area, i.e., perpendicular to the crossed fields. If sufficient electrons are provided at sufficient energies, collisions with the propellant gas atoms will form ions which are rapidly accelerated axially outward due to the electric field to provide the desired thrust.

In general, Hall effect thrusters are favored over other forms of propulsion for many applications due to their ability to produce higher specific impulses (defined as the thrust produced per unit of exhausted propellant mass) and moderate thrust levels (typically 10-4000 millinewtons depending on thruster size and operating condition) at reasonable electrical efficiencies (generally 50-60%). One of the key figures of merit used to characterize the performance of an electric propulsion device is its total electrical efficiency, which can be expressed as in Equation 1. In Equation 1, $\eta$ represents the device efficiency, $P_{thrust}$ represents the useful output thrust power, and $P_{input}$ depicts the input power supplied to the thruster.

$$\eta = \frac{P_{thrust}}{P_{input}} \tag{1}$$

In general, the input power supplied to a thruster can be divided into three parts as shown in Equation 2 where $P_{ionization}$ is the power that goes into ionizing the injected propellant atoms and $P_{other}$ is power supplied to ancillary components of the device such as electromagnets, heaters, and so on. For modern electric propulsion devices, $P_{other}$ is generally small compared to $P_{thrust}$ and $P_{ionization}$. Since $P_{other}$ is generally small and its magnitude unaffected by the subject matter of this disclosure, it can be ignored in the following discussion without loss of generality.

$$P_{input}=P_{thrust}+P_{ionization}+P_{other}\approx P_{thrust}+P_{ionization} \tag{2}$$

Note that $P_{other}$ could easily be retained in the following discussion, but doing so does not affect any of the conclusions or statements made below. The total efficiency of an electric propulsion device can then be expressed as Equation 3.

$$\eta \approx \frac{P_{thrust}}{P_{thrust}+P_{ionization}} = \frac{1}{1+\frac{P_{ionization}}{P_{thrust}}} \tag{3}$$

Equation 3 shows clearly that the efficiency of a device is maximized when the power required for ionization is minimized. In typical single-state Hall thrusters, the ionization process is strongly coupled to the thrust-producing, ion acceleration process due to the fact that electrons emitted from a single hollow cathode play a critical role in both. The result of this coupling is an inability to optimize both processes independently.

The present invention seeks to increase the device efficiency by separating the ionization and acceleration processes such that each can be optimized independently. The preferred embodiment uses helicon waves to induce ionization of the injected propellant gas. As discussed in the references cited below, helicon waves are cylindrically bounded whistler waves. Application of helicon waves is generally regarded as the most efficient method of producing a high-density, low-temperature plasma. For example, the ionization cost in a DC discharge, such as that used in a conventional Hall thruster, is typically more than a factor of ten greater than the theoretical ionization energy of the injected gas. Helicon sources, on the other hand, produce an order of magnitude more plasma for the same input power and, therefore, the ionization cost in these sources is roughly 1/10 that found in DC discharges. The improved thruster would consist of one or more helicon sources as an ionization stage and an annular acceleration stage similar to that found in conventional Hall thrusters; and, therefore, is referred to as a helicon Hall thruster or HHT.

The HHT provides several distinct advantages over conventional Hall thrusters. First is the obvious example alluded to previously and illustrated by Equation 3—a more efficient ionization process leads to lower $P_{ionization}$ and higher $\eta$. This advantage will ultimately manifest itself as a reduction in the percentage of discharge current carried by electrons as explained in more detail below. The "discharge power" going into a Hall thruster can be written as shown in Equation 4. The ion beam current and thrust power can be written as Equations 5 and 6, respectively. In these equations, $V_D$ is the discharge voltage, $I_D$ is the discharge current, $I_B$ is the ion beam current, $I_e$ is the electron current, q is the average charge state of ejected ions, $v_B$ is the average velocity of ejected ions, $m_1$ is the ion mass, and e is the electron charge. The number of ions exiting the device per unit time is denoted by the letter n with a dot over it.

$$P_{dis}=P_{input}-P_{other}=V_D I_D=V_D(I_B+I_e) \tag{4}$$

$$I_B q e \dot{n} \tag{5}$$

$$P_{thrust} = \frac{m_1 \dot{n} v_B^2}{2} = \frac{m_1 I_B v_B^2}{2qe} \tag{6}$$

It can clearly be seen from Equation 4 that the input power to the thruster includes contributions from both the ion beam current, $I_B$, and the electron current, $I_e$. The only current component contributing to useful thrust output power, $P_{thrust}$, on the other hand, is the ion current as shown in Equation 6. It then follows fundamentally that a reduction in the electron current fraction, $I_e/I_D$, results in an increase in the overall efficiency of the device. The need to ionize the injected propellant places a lower bound on the ratio of $I_e/I_D$ in typical Hall thrusters since the ionization process depends on bombardment by the electrons comprising the electron current. The HHT, on the other hand, provides for propellant ionization independent of any backstreaming electrons. This allows the magnetic field shape and strength in the acceleration stage of the HHT to be optimized so as to reduce the electron current fraction below the level possible in a conventional Hall thruster. The result is an increase in overall device efficiency.

Figure 3:
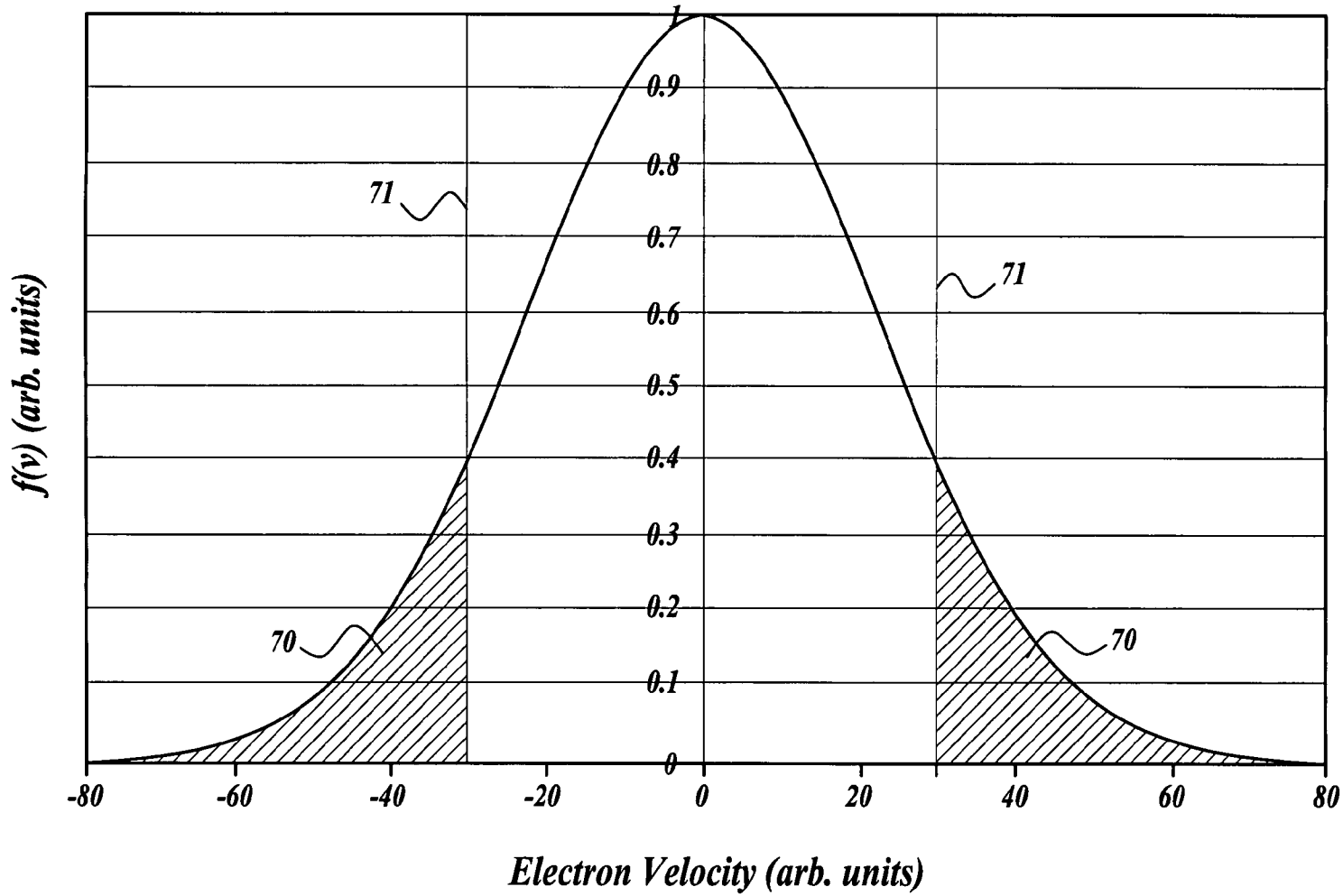
FIG. 3 is a graph illustrating electron velocity distribution for a thermal electron population emanating from an electron-emitting cathode.

Another desirable aspect of the HHT can be understood by considering in more detail the electron bombardment ionization process employed in a typical Hall thruster. In this process, ionization occurs only when a neural propellant atom is struck by an electron traveling with a kinetic energy in excess of the propellant atom's first ionization potential. For a thermal electron population, the electron velocity distribution is qualitatively similar to the function depicted in FIG. 3. In this figure, the cross-hatched areas represent electrons having sufficient energy to cause ionization; vertical lines 71 represent the velocity corresponding to the first ionization potential of the propellant atom. Since the ionization potential is a function only of the propellant gas being used, it does not change as a function of thruster operating conditions. Examination of FIG. 3 shows that the fraction of the electron population having energy in excess of the ionization threshold is a function of the width of the electron velocity distribution between lines 71, i.e., the electron temperature. While the factors determining the maximum electron temperature in a typical Hall thruster are complicated, this value can be approximated to be 10% of the applied discharge voltage for most thrusters. It follows that at the low discharge voltages required to provide operation at low specific impulse, only a small fraction of the electron population has sufficient energy to result in propellant ionization. This decreasing fraction of energetic electrons leads to an increase in the ionization cost and contributes to the dramatic decrease in overall efficiency exhibited by typical Hall thrusters at low specific impulses. The HHT is not subject to the same limitation because the helicon wave ionization process does not depend on the discharge voltage. The ionization cost in the HHT is, therefore, essentially constant over any range of discharge voltage, and the HHT should be capable of providing efficient operation at specific impulses significantly below that achieved by other Hall thrusters.

Based on the discussion above, the advantages of the HHT of the present invention over other electric propulsion devices, particularly conventional Hall thrusters, can be summarized as follows:

1. The low ionization cost of the helicon ionization mechanism, which can be as low as 10% of the ionization cost found in DC discharges, leads to a reduction in power required for propellant ionization and a resultant increase in device efficiency.

2. The decoupling of the ionization process from the acceleration process allows the electron current fraction, $I_e/I_D$, to be reduced below the levels possible for conventional Hall thrusters. This results in an increase in the overall efficiency of the device.

3. The cost of ionization in the HHT is essentially independent of the specific impulse at which the thruster is operating. Since the ionization cost in a typical Hall thruster tends to increase at low specific impulse, the HHT should provide the greatest advantage in device efficiency at low specific impulses.

Helicon Plasma Sources

Detailed discussions of helicon plasma sources and geometries, factors, etc., are described in, for example:

1. Chen, F. F., "Experiments on helicon plasma sources," *Journal of Vacuum Science and Technology A,* Vol. 10, No. 4, July-August, 1992.

2. Cluggish, B. P., et al., "Density profile control in a large diameter, helicon plasma," *Physics of Plasmas,* Vol. 12, April 2005.

3. Chen, F. F., "Plasma Ionization by Helicon Waves," *Plasma Physics and Controlled Fusion, Vol.* 33, No. 4, pp. 339-364, 1991.

4. S. Yun, et al., "Density enhancement near lower hybrid resonance layer in m=0 helicon wave plasmas," *Physics of Plasmas,* Vol. 8, No. 1, pp. 358-363, 2001.

5. Chen, F. F., "The low-field density peak in helicon discharges," *Physics of Plasmas,* Vol. 10, No. 6, pp. 2586-2592.

6. Lieberman, M. A., and A. J. Lichtenberg, *Principles of Plasma Discharges and Materials Processing: Second Edition,* John Wiley & Sons, Inc., Hoboken, N.J., 2005, pp. 513-527.

Helicon plasma sources are generally created by surrounding a cylindrical, non-metallic tube with an RF antenna. When low frequency whistler waves are confined to a cylinder, they lost their electromagnetic character and become partly electrostatic, changing their propagation and polarization characteristics, as well. These bounded whistlers, called helicons, are very efficient in producing plasmas. Absorption of RF energy has been found to be more than one thousand times faster than the theoretical rate due to collisions.

Figure 4:
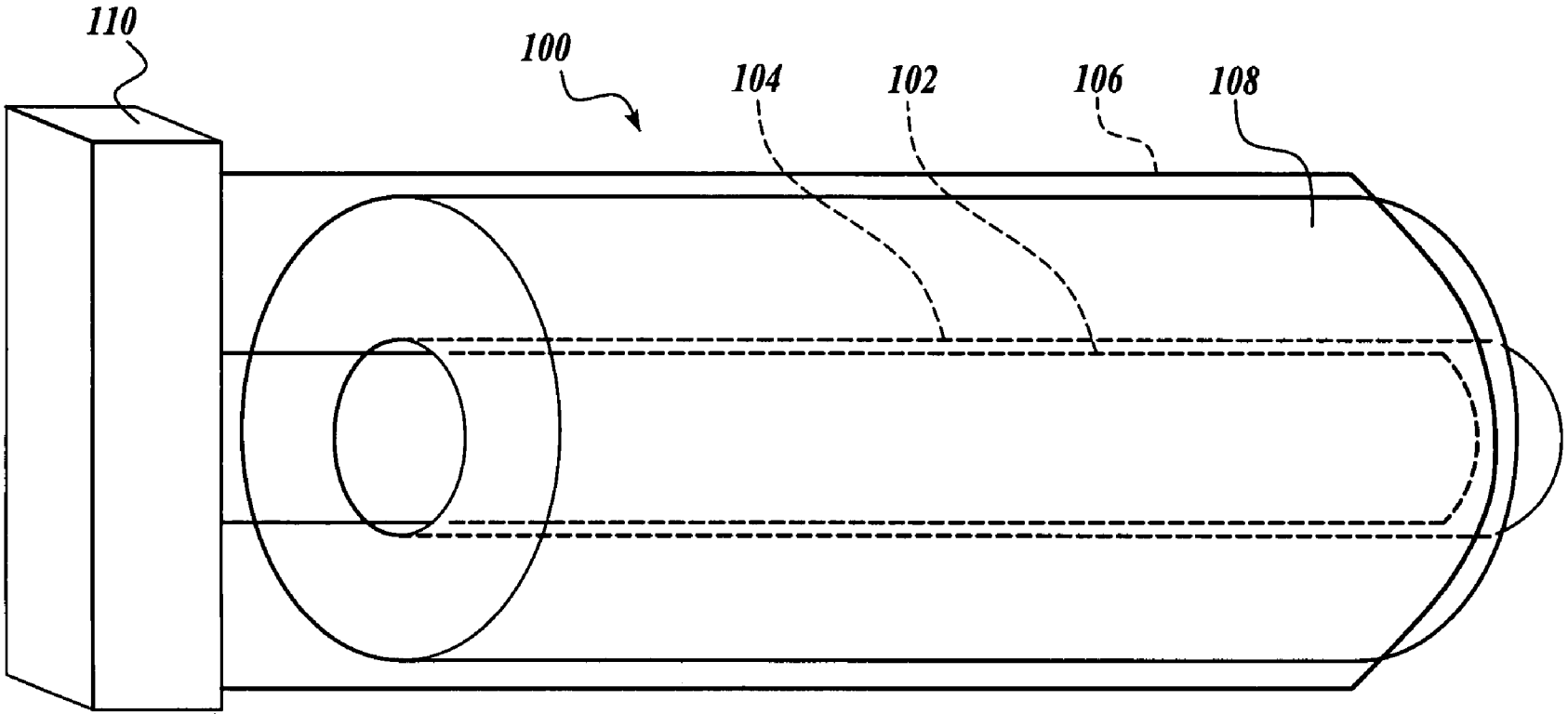
FIG. 4 is a diagrammatic illustration of an annular helicon plasma source.

In accordance with a preferred embodiment of the present invention, the helicon ionization stage would be annular in geometry to meet smoothly with an annular Hall effect acceleration stage. With reference to FIG. 4, the helicon ionization stage 100 includes a first, inner antenna 102 located within an inner cylinder 104. An outer antenna 106 encircles an outer cylinder 108, concentric with and spaced outward from the inner cylinder 104. The power supply, antenna excitation circuitry, propellant supply, and so, are represented by box 110. Creation of such an annular helicon source requires control of both an inner and outer boundary condition, possible with proper selection of antenna geometry and phasing.

Annular Helicon Source Theory

It is worth noting that the predicted performance of the HHT was calculated using fairly conservative assumptions. In particular, these calculations assumed that the ionization cost in the HHT will be a factor of 4 higher than the theoretical minimum, despite the fact that other researchers have demonstrated ionization costs as low as 1-2 times the theoretical minimum. The prediction of HHT performance also assumes an energy loss due to radial ion acceleration equaling more than 20% of the directed thrust power. This value was selected based on measurements of known HETs. Despite these conservative assumptions, the reduced ionization cost provided by the helicon source is expected to enable the HHT to exceed efficiencies currently available in HETs.

Concerning the annular helicon source as compared to the established cylindrical sources of the references above, the properties of helicon waves may be derived starting with the relations shown in Equations 7-9 where E, B, and j represent electric field, magnetic field, and current density vectors, respectively. The symbols n, $\mu_0$, and e represent plasma density, the permittivity of free space, and the electronic charge, respectively. Henceforth, symbols with the subscript 0 represent static quantities while variables without subscripts denote perturbed, or wave, quantities.

$$\nabla \times \vec{E} = -\frac{\partial \vec{B}}{\partial t} \tag{7}$$

$$\nabla \times \vec{B} = \mu_0 \vec{j} \tag{8}$$

$$\vec{E} = \frac{\vec{j} \times \vec{B}_0}{en_0} \tag{9}$$

Manipulation of Equations 7-9 leads to Equations 10-12, where the subscript $\perp$ represents the direction perpendicular to the static magnetic field, which is assumed to be in the axial, z, direction by convention. In the derivation of Equations 10-12, it has been assumed that the frequency range of interest is high enough that ion motions can be neglected and low enough that electron cyclotron motion can be neglected relative to guiding center motion.

$$\nabla \cdot \vec{B} = 0 \tag{10}$$

$$\nabla \cdot \vec{j} = 0 \tag{11}$$

$$\vec{j}_{\perp} = -\frac{en_0\vec{E}\times\vec{B}_0}{B_0^2} \tag{12}$$

Given the fundamental relations of Equations 7-12, the derivation of helicon wave parameters can proceed by assuming perturbations of the form exp [i(mθ+kz−ωt)], where k is referred to as the axial wavenumber and m is often called the wave mode or azimuthal mode. Assuming waves of this form and combining Equations 7-9 leads to Equation 13. Defining the parameter α according to Equation 14 and taking the curl of Equation 13 results in Equation 15, which is the main equation from which subsequent helicon wave relations are derived. The symbols $\omega_c$ and $\omega_p$ represent the electron cyclotron and electron plasma frequencies, respectively.

$$\vec{B} = \left(\frac{kB_0}{\omega\mu_0 en_0}\right)\nabla\times\vec{B} \tag{13}$$

$$\alpha \equiv \frac{\omega}{k}\frac{\mu_0 en_0}{B_0} = \frac{\omega}{k}\frac{\omega_p^2}{\omega_c c^2} \tag{14}$$

$$\nabla^2\vec{B}+\alpha^2\vec{B}=0 \tag{15}$$

Further, by comparing Equation 13 with Equation 8, one can deduce Equation 16, which reveals that the wave current is parallel to the perturbed magnetic field for this type of wave. This point will become important later when boundary conditions are applied to the general relations.

$$\vec{j} = \left(\frac{\alpha}{\mu_0}\right)\vec{B} \tag{16}$$

Separating Equation 15 into components and formulating the problem in cylindrical coordinates leads to Equation 17 for the z component. Here T is defined as shown in Equation 18. It can be seen by examination that Equation 17 is a form of Bessel's equation, the general solution of which is given by Equation 19 where $J_m$ and $Y_m$ are the Bessel functions of the first and second kind (order m), respectively, and $C_1$ and $C_2$ are constants of integration.

$$r^2\frac{\partial^2 B_z}{\partial r^2} + r\frac{\partial B_z}{\partial r} + (r^2T^2 - m^2)B_z = 0 \tag{17}$$

$$T^2 = \alpha^2 - k^2 \tag{18}$$

$$B_z = C_1 J_m(Tr) + C_2 Y_m(Tr) \tag{19}$$

Because $Y_m$ diverges at small values of Tr, physically meaningful solutions are generally taken to be those for which $C_2=0$, such that the axial wave magnetic field is given by Equation 20.

$$B_z = C_1 J_m(Tr) \tag{20}$$

The r and θ components of Equation 15 can be written as Equations 21 and 22, respectively, which can be solved in terms of $B_z$ and its radial partial derivative.

$$\frac{im}{r}B_z - ikB_\theta = \alpha B_r \tag{21}$$

$$ikB_r - \frac{\partial B_r}{\partial r} = \alpha B_\theta \tag{22}$$

Substituting Equation 20 into this result yields Equations 23 and 24, which, along with Equation 19, define all three components of the wave magnetic field.

$$B_r = \frac{iC_1}{T^2}\left[\frac{m\alpha}{r}J_m(Tr) + k\frac{\partial J_m(Tr)}{\partial r}\right] \tag{23}$$

$$B_\theta = \frac{-C_1}{T^2}\left[\frac{mk}{r}J_m(Tr) + \alpha\frac{\partial J_m(Tr)}{\partial r}\right] \tag{24}$$

The wave electric field follows directly from Equation 7 and its components are given here for reference as Equations 25-27.

$$E_r = \frac{\omega}{k}B_\theta \tag{25}$$

$$E_\theta = -\frac{\omega}{k}B_r \tag{26}$$

$$E_z = 0 \tag{27}$$

At this point it is worth reiterating that all of the results shown above are universal and are not a function of geometry. In other words, no assumptions have been made that would limit the applicability of the above results to cylindrical rather than annular sources. One can now proceed with the application of boundary conditions by assuming cylindrical boundaries of arbitrary radius. For an insulating boundary, the condition $j_r=0$ must hold, and from Equation 16 this required $B_r=0$. On the other hand, a conducting boundary condition requires $E_\theta=0$, which also requires $B_r=0$ according to Equation 26. Thus, regardless of the nature of the bounding wall, the condition $B_r=0$ must hold at the physical boundaries of the plasma. From Equation 23, we can then establish the boundary condition shown in Equation 28 at $r=R_{wall}$.

$$m\alpha J_m(TR_{wall}) + kR_{wall}\frac{\partial J_m(TR_{wall})}{\partial r} = 0 \tag{28}$$

At this point, one can solve Equation 28 by first selecting a wave mode (m=0, 1, etc.), which is physically determined by the geometry of the driving antenna. The most common wave modes for helicon sources are the m=0 and m=1 modes. Examining first the m=0 mode, we see that a nontrivial solution to Equation 28 requires that the derivative of the zeroeth order Bessel function must go to zero at the boundaries. By applying the well-known recurrence relation shown in Equation 29, this requirement can be written more conveniently as a requirement on the first order Bessel function as shown in Equation 30. Equation 30 then gives an exact boundary condition for the m=0 mode.

$$\frac{\partial J_m(x)}{\partial r} = \frac{m}{x} J_m(x) - J_{m+1}(x) \tag{29}$$

$$J_1(TR_{wall})=0 \tag{30}$$

In general, Equation 30 is satisfied for cylindrical helicon sources since $J_1$ goes to zero at r=0 and the bounding cylinder then forces the Bessel function to zero by satisfying the condition $TR_{wall}=3.83$ where 3.83 is the first root of $J_1$. The boundary condition thus simply specifies a relation between the transverse wave number, T, and the geometry of the bounding cylinder. For the purposes of the HHT, however, the solutions of greatest interest are those that do not rely on the trivial zero of the Bessel function at r=0. Such a solution can be obtained if one concentrates not on the area between r=0 and the first zero of $J_1$, but rather on the area between the second and third zeroes of the Bessel function (or other zeroes at finite radii). Considering an annular source with boundaries at $R_{inner}$ and $R_{outer}$ then gives the condition shown in Equation 31.

$$J_1(TR_{inner})=J_1(TR_{outer})=0 \tag{31}$$

This relation is satisfied between the second and third zeroes of $J_1$, which defines the requirements of Equation 32.

$$TR_{inner}=7.02 \quad TR_{outer}=10.17 \text{ tm} \tag{32}$$

The inner and outer radii of the annulus are then related through Equation 33.

$$\frac{R_{outer}}{R_{inner}} = \frac{10.17}{7.02} = 1.45 \tag{33}$$

Figure 5:
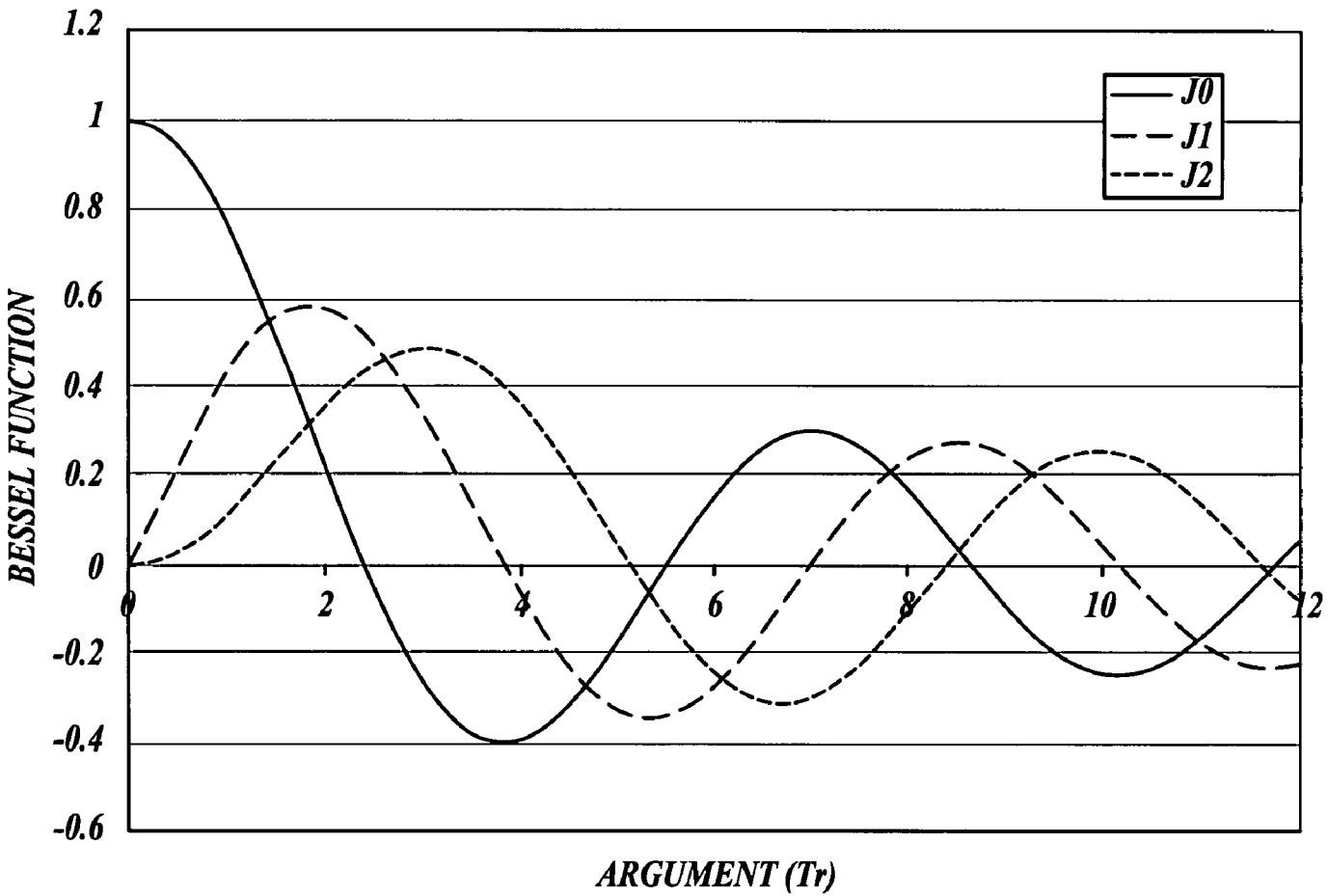
FIG. 5, FIG. 6, and FIG. 7 are graphs illustrating aspects of the mathematical basis for helicon plasma source theory.

Thus, so long as the proper relationship between $R_{inner}$ and $R_{outer}$ is maintained, it is possible to create an annular discharge while maintaining the fundamental properties of the helicon source for the m=0 mode. For reference, the $J_0$–$J_2$ Bessel functions are plotted in FIG. 5 as a function of their argument, Tr.

For the m=1 mode, the relation shown in Equation 28 can be reformulated by applying the substitution Z=Tr and utilizing the chain rule to write the boundary condition on $B_r$ as Equation 34.

$$(\text{valid at } Z = TR_{wall})\ J_m(Z) = -\frac{kZ}{m\alpha}\frac{\partial J_m(Z)}{\partial Z} \tag{34}$$

Applying the recurrence relation of Equation 35 allows Equation 34 to be written as Equation 36, where we have explicitly taken m=1.

$$\frac{\partial J_m(Z)}{\partial Z} = \frac{1}{2}[J_{m-1}(Z) - J_{m+1}(Z)] \tag{35}$$

$$(\text{valid at } Z = TR_{wall})\ J_1(Z) = \frac{kZ}{2\alpha}[J_2(Z) - J_0(Z)] \tag{36}$$

Figure 6:
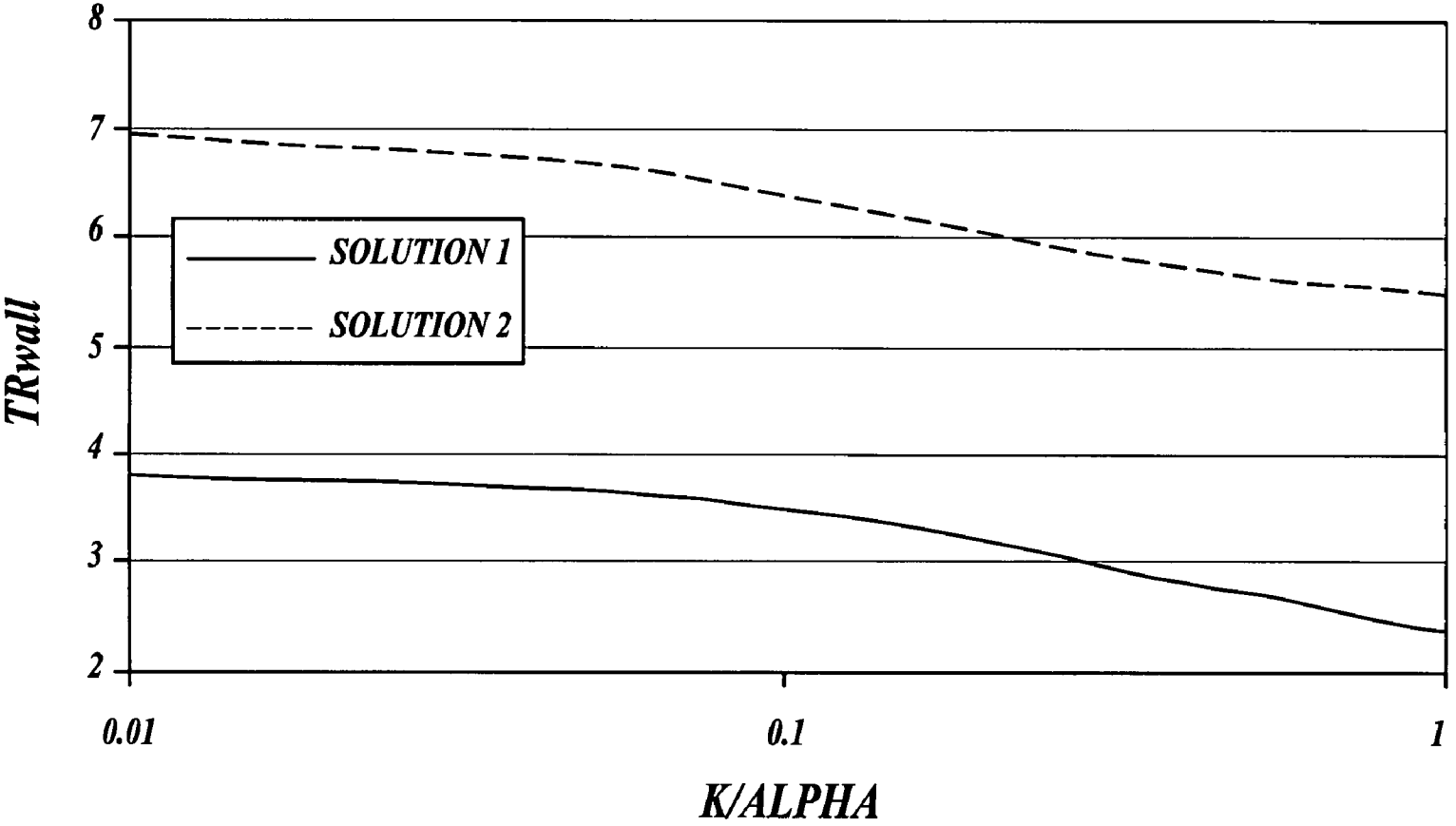
Figure 7:
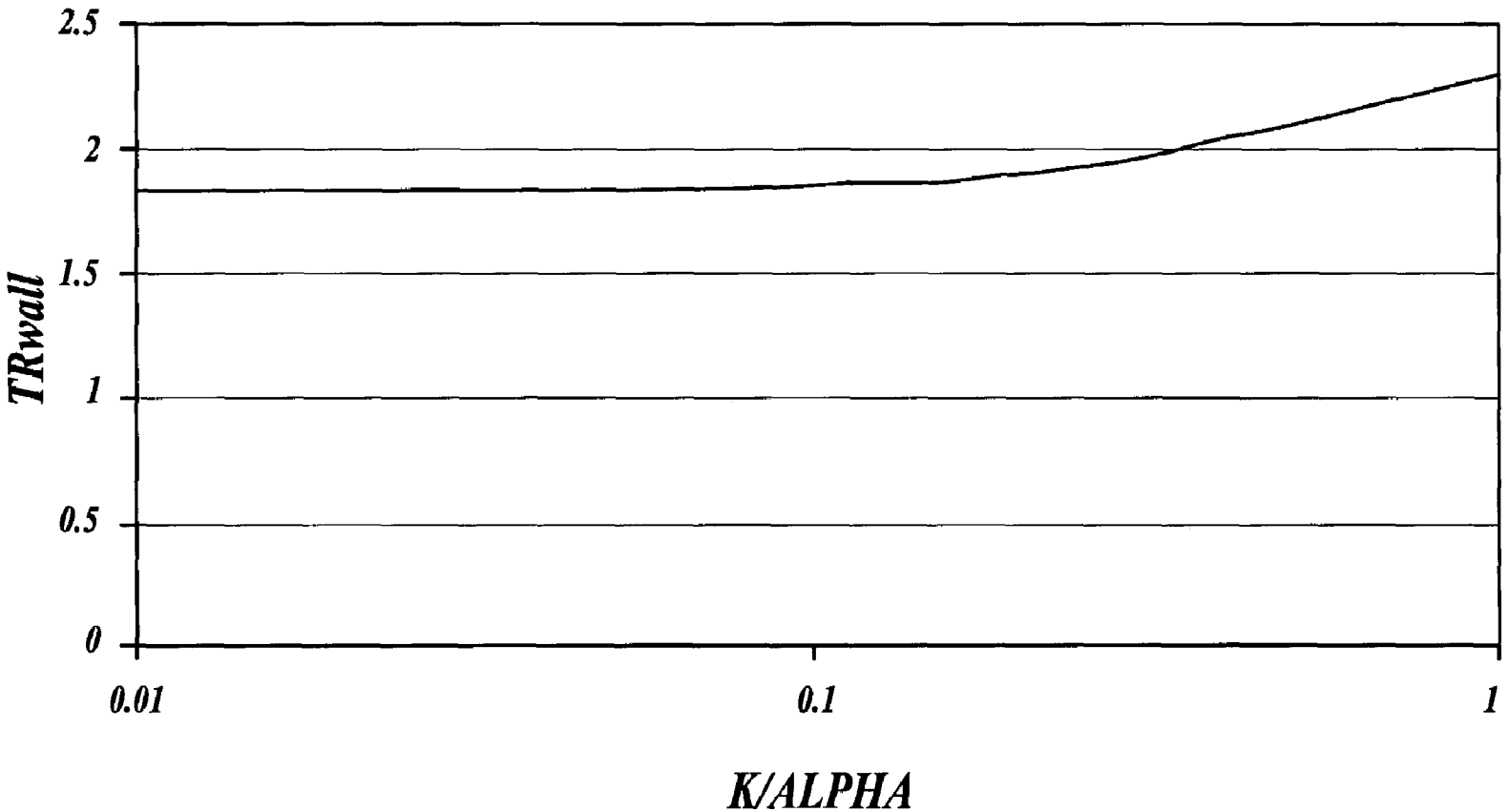

Finally, this equation can be solved numerically for $Z=TR_{wall}$ in terms of k/α. The two lowest order solutions are shown in FIG. 6 and can be interpreted as giving required conditions for $TR_{inner}$ and $TR_{outer}$ just as Equation 32 did for the m=0 mode. Taking the ratio of these curves gives the value of $R_{outer}/R_{inner}$ needed to satisfy the boundary condition $B_r=0$ at the walls of an annular source for the m=1 wave mode. This ratio is shown in FIG. 7 and can be seen to vary with k/alpha. Recalling this α is entirely determined by T and k through Equation 18 reveals the fact that FIG. 7 specifies a required relationship between $R_{outer}/R_{inner}$ and k/T. In other words, for the m=1 mode, there is a unique relationship between the antenna aspect ratio (which defines k/T) and the annulus geometry.

Having determined the boundary conditions and geometric relations necessary to excite either the m=0 or m=1 modes in an annular helicon discharge, it is logical to next determine the absolute dimensions desired for the ionization source of the HHT. It is recommended to use the results and suggestions specified here to perform a proof-of-concept demonstration in order to verify the viability of the annular helicon source. Since some flexibility is available in sizing the acceleration stage of the HHT to achieve a desired power level, there are three main constraints in determining the dimensions for a proof-of-concept test. The first is the need to maintain an inner diameter sufficiently large to accommodate a magnetic circuit for the HHT acceleration stage. The second constraint is the desire to utilize parts that can be readily procured in the sizes needed. In particular, the dimensions of the quartz tube that is traditionally used to form the physical boundary of the helicon should be chosen to be a commonly available size. Finally, a proof-of-concept test should be amenable to being easily reconfigured in order to examine a variety of antenna geometries. Considering these constraints, it is recommended that an annular source be built around a quartz tube with a diameter of approximately 15 cm. This tube will form the outer boundary of the annular source and an appropriate antenna will be placed external to the quartz tube. Since it has been shown that the wall material has no effect on the boundary conditions at the plasma edge, i.e., it makes no difference whether the wall is insulating or conductive, it is recommended that the inner diameter of the annular source be constructed of a metallic tube to facilitate economical examination of multiple geometries. Since the plasma discharge will be located between the antenna and the inner radius of the annulus, the inner wall is not required to be transparent to RF energy and therefore it is perfectly acceptable to construct this surface of a non-magnetic metal such as copper or stainless steel.

The final major parameter that must be selected in the design of an annular helicon source is the geometry of the driving antenna, which in turn influences the required diameter of the inner wall of the annulus, as explained above. Both the m=0 and m=1 modes offer specific advantages and independent consideration of each is warranted. Considering first the m=0 mode, we note an important property revealed by Equations 32-33; the required geometric ratio, $R_{outer}/R_{inner}$, is constant. This means that the geometry of the physical annulus required to meet the wave boundary conditions is not fundamentally linked to the exact dimensions of the driving antenna so long as it excites the m=0 mode. Of particular interest is the fact that the m=0 mode is amenable to being driven by a single loop antenna located external to the outer cylinder of the helicon source. Experiments and simulations utilizing this method of excitation have revealed that maximum energy absorption, and hence maximum plasma density, occurs directly under the antenna, and that the m=0 mode is more efficient than the m=1 mode at low magnetic field strengths near the lower hybrid frequency. Both of these traits are advantageous for the HHT. The ability to create an efficient discharge directly under a single-loop antenna introduces the possibility of creating a short, compact ionization stage for the HHT. This will aid in the creation of a relatively simple magnetic circuit and, due to its mechanical simplicity, will facilitate eventual maturation of the HHT into a flight-worthy device. The ability of the m=0 mode to operate efficiently at low magnetic field strengths may also prove useful in design of the magnetic circuit for the HHT as it will potentially lower the required mass and volume of the ionization stage magnets depending, of course, on the outcome of proof-of-concept tests. The only known potential disadvantage of using the m=0 helicon mode in a helicon discharge relates to the radial plasma profiles that may be expected. It has been shown that a space charge proportional to $B_z$ builds up within a helicon plasma during each wave cycle. Because the $J_0$ Bessel function, and $B_z$ according to Equation 20, reaches a maximum near both the inner and outer walls of the discharge for the m=0 mode, one can expect the local space charge and perhaps the plasma density to be reached in these regions as well. This may lead to increased wall losses compared to a profile that is peaked in the center of the annulus, although the magnitude of this loss is unknown.

Considering next the m=1 mode, we recall from the explanation of FIG. 6 that there is a unique relation between the annulus geometry and the characteristics of the driving antenna, and therefore the two cannot be specified independently. As a starting point, we note from the work of Lieberman and Lichtenberg (reference 6 above under the heading Helicon Plasma Sources) that antennae providing $T \approx k$ provide the optimum combination of plasma density and antenna coupling. To ensure margin in antenna coupling requirements T is usually chosen to be slightly larger than k, and a value of T=2k is a reasonable starting point for proof of concept experiments. Setting this requirement, we then have $k/\alpha = 1/\sqrt{5} \approx 0.46$, which requires $R_{outer}/R_{inner} \approx 2.05$ from Equation 36. For an outer radius of 7.5 cm, satisfying the above relations yields $T \approx k \approx 7.92\ cm^{-1}$. This can be accomplished using a half-wavelength, helical twist antenna 8.25 cm long and designed to excite an axial wavelength of 16.5 cm. In addition to the disadvantage of the relatively long physical length of this antenna, the m=1 mode also suffers in comparison to the m=0 mode in that the plasma density peak tends to occur downstream of the antenna thus further increasing the required length of the ionization stage. This mode, however, does have the advantage of providing a space charge distribution that is peaked near the center of the annular channel and therefore may produce lower radial ion losses compared to the m=0 mode. For this reason, it is recommended that an m=1 mode annular helicon source be considered as a secondary option after demonstrating an m=0 mode source.

Magnetic Circuit Design

Figure 8:
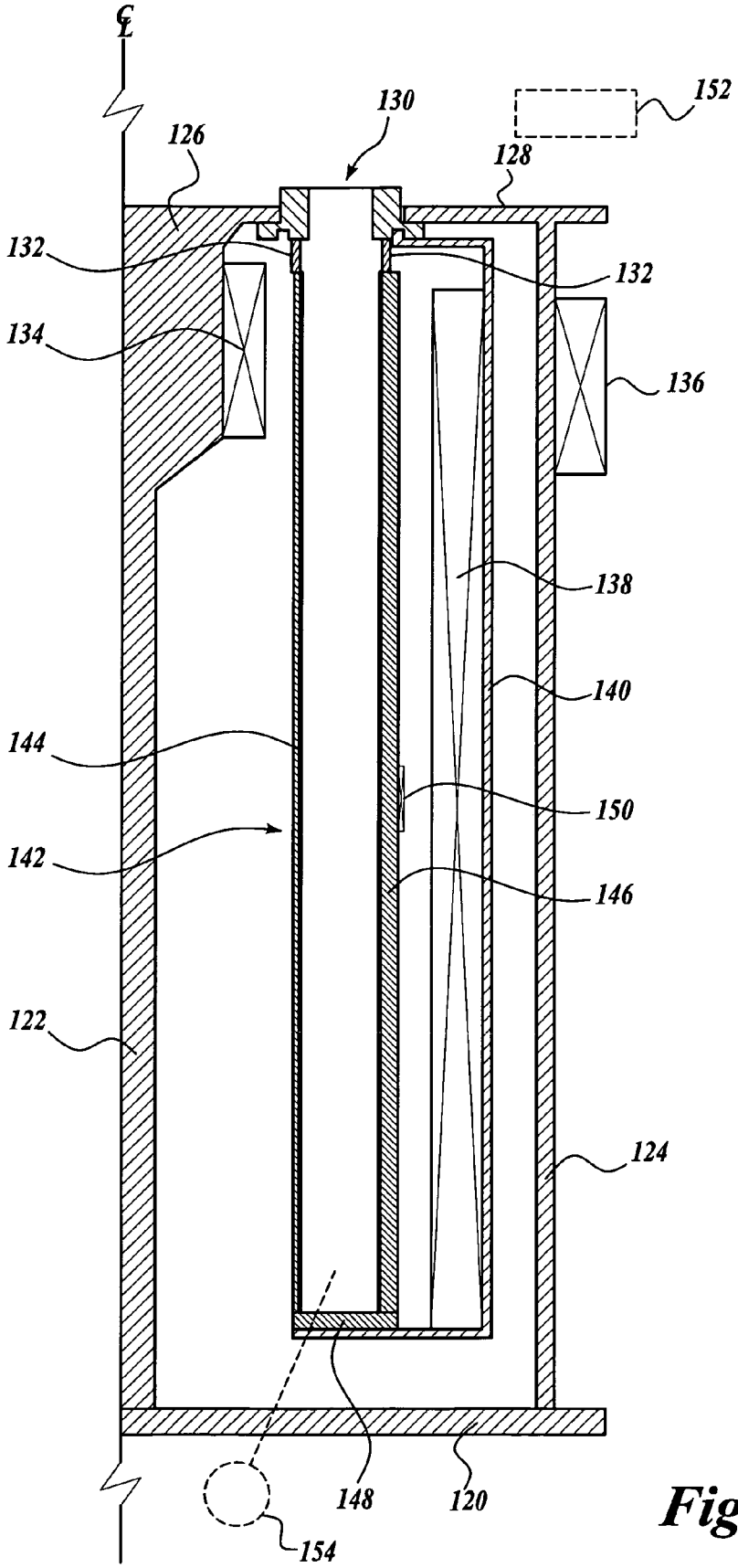
FIG. 8 is a diagrammatic axial section of a helicon Hall thruster in accordance with the present invention.

After establishment of the requirements for creation of an annular helicon source, one can proceed with the design of a magnetic circuit for the HHT. This can be accomplished using the MagNet™ magnetostatic simulation package of Infolytica Corporation (www.infolytica.com). The design of the HHT can be commenced by first selecting the diameter of the quartz tube forming the outer wall of the helicon stage. If this dimension is set to 15 cm, the inner diameter of the helicon annulus, which is composed of a nonmagnetic, conductive cylinder, is set to 10.34 cm. These dimensions are chosen to establish a ratio of 1.45 between the inner and outer diameters, which was previously shown to be the optimum geometry for creation of an m=0 mode plasma. The preliminary length of the helicon ionization stage can be set to 30 cm, although the magnetic circuit design can be scaleable in length without negative impacts on the key parameters of the magnetic field. After establishing the physical geometry of the helicon stage, a variety of magnetic circuits can be simulated to determine a suitable approach. After examining approximately 100 different variations, the geometry shown in FIG. 8 was selected as preferred. As shown in FIG. 8, the main structure of the magnetic circuit includes a back plate 120, a midstem 122 and a cylindrical outer core 124. Each of these components are made of magnetic iron. The front 126 of the midstem and the front flange 128 shown in FIG. 8 are used to shape the magnetic fields at the front of the thruster so as to create radial fields in the acceleration region 130, i.e. downstream of the anode rings 132. The magnetic fields in both the ionization and acceleration stages are generated by three independently controlled electromagnets, which are denoted as the inner coil 134, outer coil 136, and helicon coil 138. Currently these coils are sized to be comprised of 200 turns of AWG 18 wire for the inner and outer coils and 1500 turns of the same wire for the helicon coil. An iron shunt 140 surrounding the helicon coil provides a return path for flux lines in the ionization region and acts to minimize the interference of the axial magnetic field lines with the radial field lines of the acceleration stage.

FIG. 8 illustrates the helicon plasma source 142, including the conductive inner cylinder 144 and nonconductive, quartz outer cylinder 146 and base 148. The helicon antenna is diagrammatically represented at 150, and the cathode for the acceleration stage at 152. The cathode can be of the same design as those currently used in known HETs. The propellant gas supply is diagrammatically represented at 154. The diagrammatic representations of the electrically/RF powered components include the required power supplies, circuits, and so on.

Figure 9:
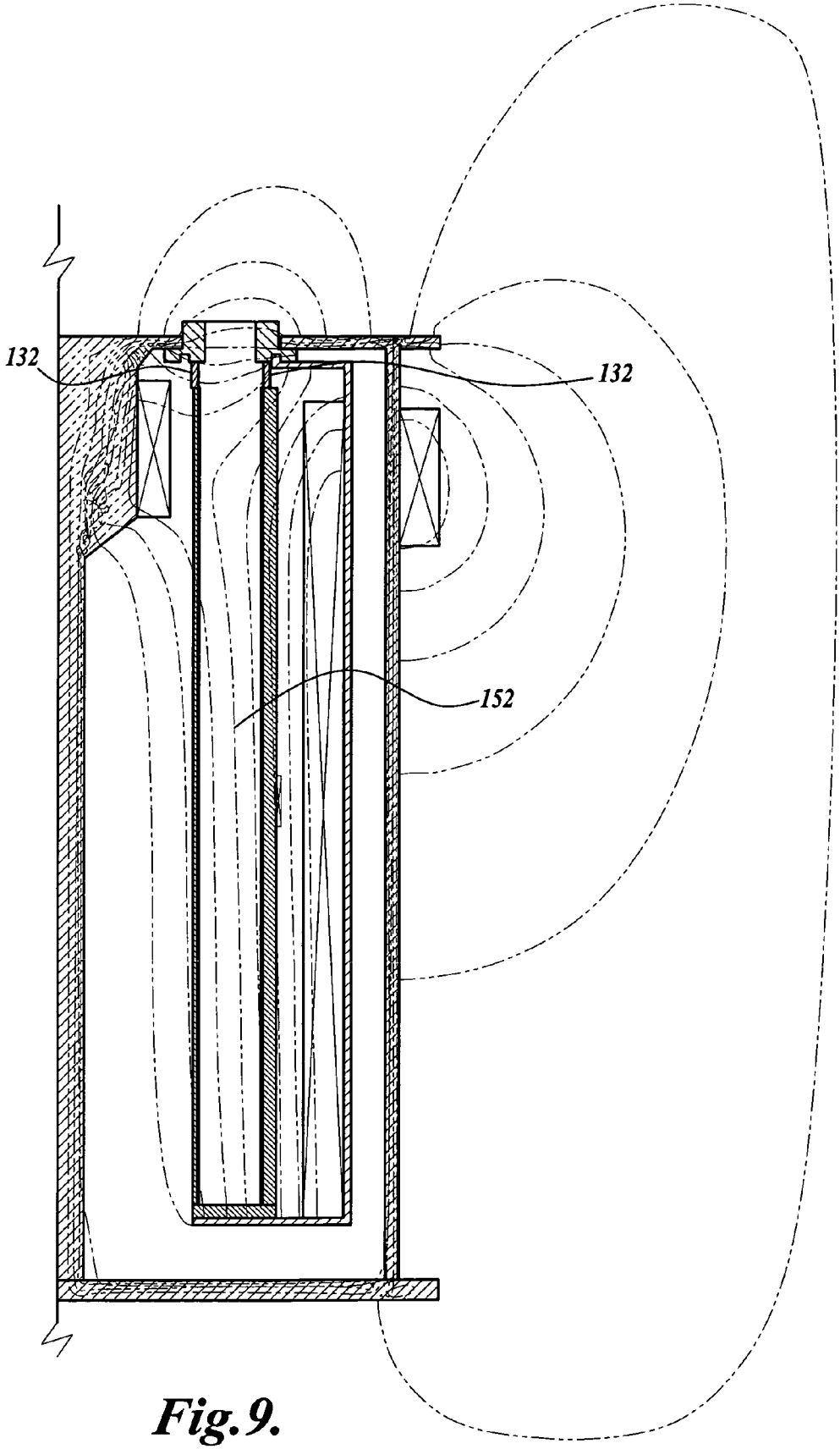
FIG. 9 is a diagrammatic section illustrating magnetic field lines present in the thruster of FIG. 8.

The magnetic circuit shown in FIG. 8 was simulated at a variety of different coil currents. FIG. 9 illustrates aspects of the field produced with 6 A on the helicon and inner coils, and with 4 A on the outer coil. In this figure, the broken lines represent magnetic field lines (lines of force). The selected configuration is capable of producing field strengths greater than 500 gauss in the acceleration region (outward of the electrically based anode rings 132) where the field lines are generally radial, and greater than 350 gauss in the ionization region 152 of the helicon source where the field lines are generally axial. This field strength is considerably higher than that typically employed in conventional Hall effect thrusters, but the additional capability is expected to be beneficial for the HHT. Because the main plasma generation in the HHT will occur in the helicon region, it should be possible to minimize electron current backstreaming and thereby maximize thruster efficiency by employing a stronger than typical magnetic field in the acceleration zone.

Figure 10:
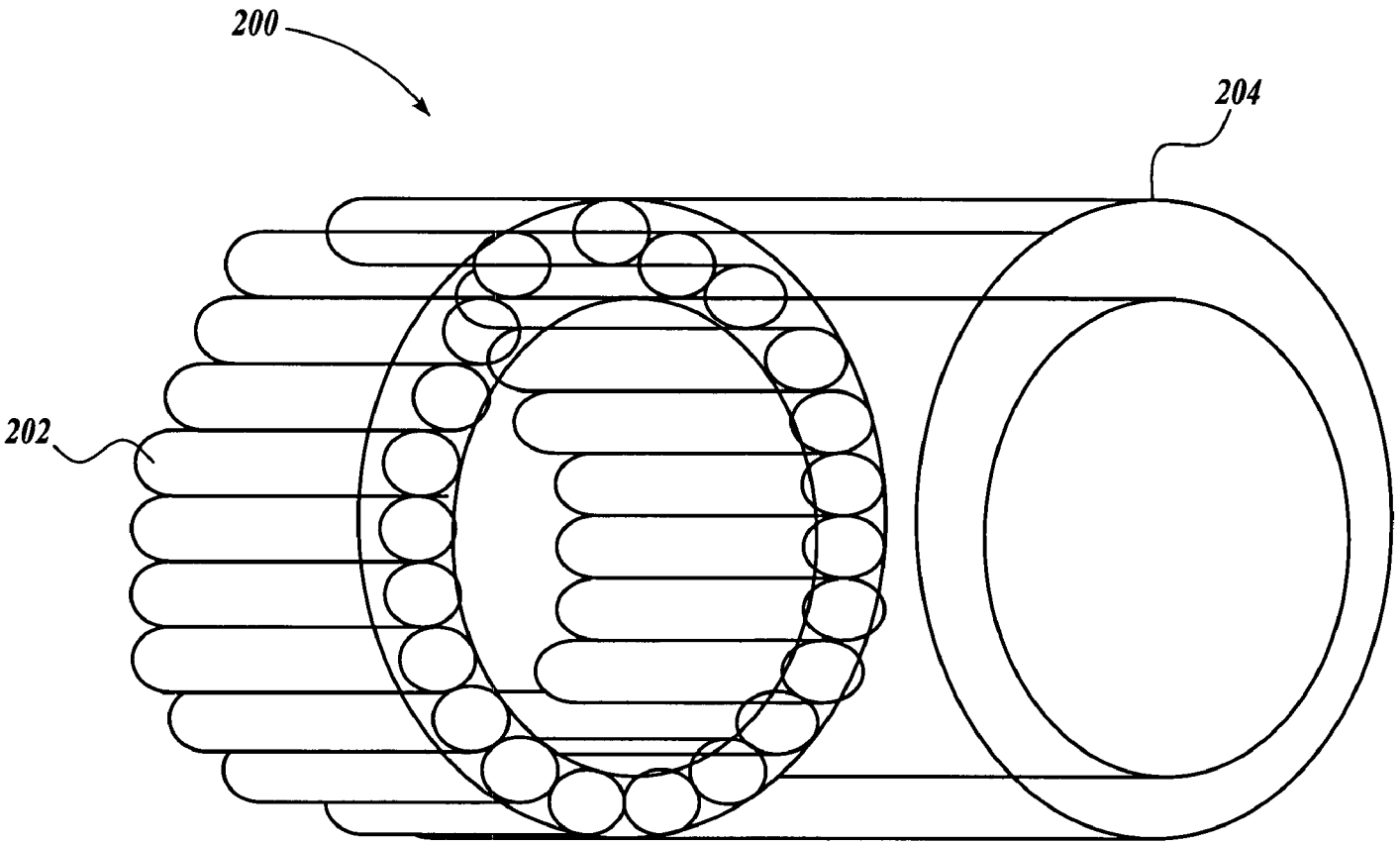
FIG. 10 is a diagrammatic view of a second embodiment of helicon Hall thruster.
Figure 11:
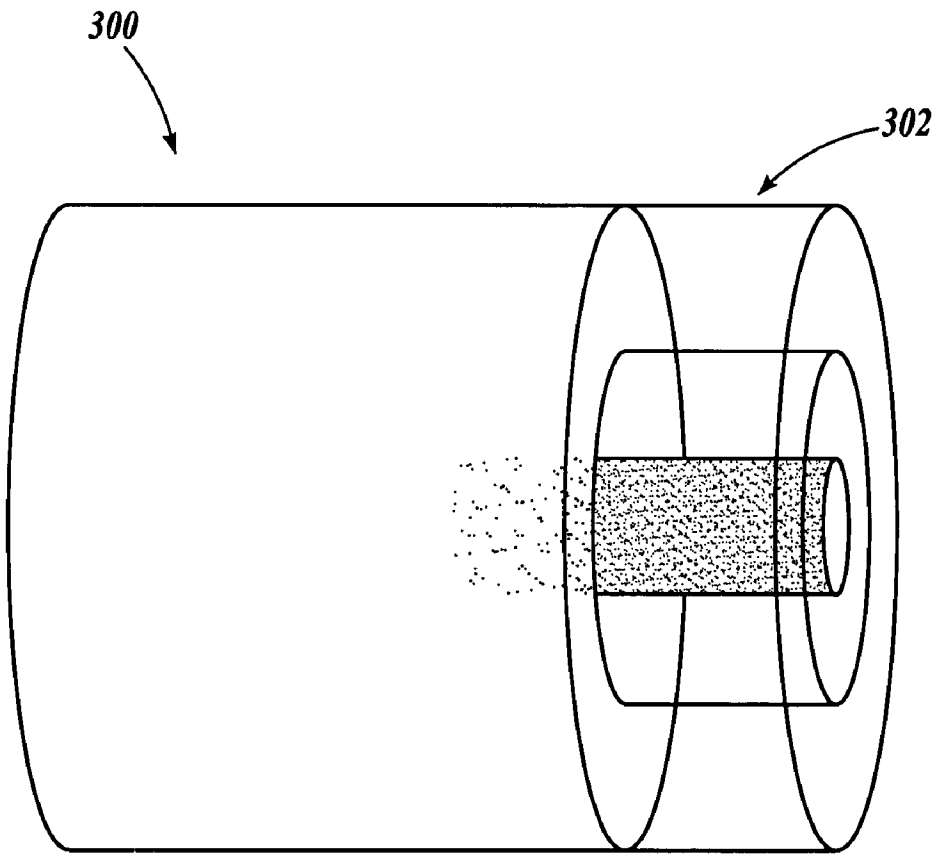
FIG. 11 is a diagrammatic view of a third embodiment of helicon Hall thruster.

Other variants of the HHT are possible. In the configuration of FIG. 10, helicon source 200 is formed of individual cylindrical helicons 202 arranged side by side and in a encircle to approximate an annular source to mate with the magnetic acceleration stage represented diagrammatically at 204. In the variant of FIG. 11, a single large, cylindrical helicon source 300 is coupled to an annular acceleration stage 302. Nevertheless, the previously described annular helicon source is currently preferred.

While illustrative embodiments have been illustrated and described, it will be appreciated that various changes can be made therein without departing from the spirit and scope of the invention.

The embodiments of the invention in which an exclusive property or privilege is claimed are defined as follows:

1. A thruster comprising:

an electrical and magnetic acceleration stage having an endless, annular ion exit area, a magnetic structure for creating a generally radially directed magnetic field across the exit area and an electrical structure creating an electrical field generally perpendicular outward relative to the annular exit area, the magnetic structure including a midstem and a cylindrical outer core spaced outward of the midstem and defining an annular space therebetween, the midstem and outer core having corresponding front portions adjacent to the exit area and corresponding rear portions remote from the exit area, the magnetic structure further including a back plate magnetically coupling the midstem and outer cylindrical core at their rear portions; and a helicon plasma source for creating ions of propellant gas, the helicon plasma source being annular, having an inner cylinder and an outer cylinder spaced from the inner cylinder, an ion creation zone between the two cylinders, the ion creation zone being aligned with the annular exit area of the acceleration stage, the helicon plasma source having a magnetic circuit creating a generally axially directed magnetic field in the ion creation zone as compared to the generally radially directed magentic field across the exit area, the helicon plasma source being disposed within the annular space bounded by the midstem, outer core, and back plate of the magnetic structure.

2. The thruster defined in claim 1, in which the helicon plasma source includes an excitation antenna located in the annular space bounded by the midstem, cylindrical outer core, and back plate of the magnetic structure.

3. The thruster defined in claim 1, including a magnetic shunt surrounding the helicon plasma source outer cylinder to provide a return path for flux lines in the ion creation zone and to minimize the interference of the axial magnetic field lines in the ion creation zone with the radial field lines of the acceleration stage.

4. The thruster defined in claim 1, including a propellant gas supply introducing propellant gas into the ion creation zone of the helicon plasma source.

* * * * *